US005473519A

United States Patent [19]

McCallops et al.

[11] Patent Number: 5,473,519

[45] Date of Patent: Dec. 5, 1995

[54] LIGHT RING FOR POWER TOOLS

[75] Inventors: John A. McCallops, Sayre; Donald R. Warner, Columbia Cross Roads; Kenneth J. Dubuque, Athens, all of Pa.

[73] Assignee: Ingersoll-Rand Company, Woodcliff Lake, N.J.

[21] Appl. No.: 401,382

[22] Filed: Mar. 9, 1995

[51] Int. Cl.[6] ..... B25B 23/18

[52] U.S. Cl. ..... 362/120; 362/119; 362/800; 362/812

[58] Field of Search ..... 362/119, 120, 362/812, 800; 40/544, 913; 340/825.17, 815.45; 345/39

[56] References Cited

U.S. PATENT DOCUMENTS

| | | | |
|---|---|---|---|
| 2,855,679 | 10/1958 | Gibble | 362/119 |
| 3,461,448 | 8/1969 | Kramer | 362/119 |
| 3,724,931 | 4/1973 | Nevyas et al. | 362/120 |
| 3,846,777 | 11/1974 | Brown | 362/119 |
| 4,173,035 | 10/1979 | Hoyt | 362/812 |
| 4,467,193 | 8/1984 | Carroll | 362/800 |
| 4,839,777 | 6/1989 | Janko et al. | 362/800 |
| 5,068,652 | 11/1991 | Kobayashi | 362/800 |
| 5,276,595 | 1/1994 | Patrie | 362/800 |
| 5,406,300 | 4/1995 | Tokimoto et al. | 345/39 |
| 5,412,546 | 5/1995 | Huang | 362/119 |

*Primary Examiner*—Ira S. Lazarus
*Assistant Examiner*—Alfred Basichas
*Attorney, Agent, or Firm*—Walter C. Vliet

[57] ABSTRACT

Disclosed is a 360 degree viewable flexible light band which may be readily disposed on a power tool which permits ready viewing of tool function in terms of required communication to the operator. Construction of the light band makes it readily installable and replaceable in a tool recess which may be covered by a clear lens to permit viewing.

6 Claims, 1 Drawing Sheet

LIGHT RING FOR POWER TOOLS

BACKGROUND OF THE INVENTION

This invention relates to light ring for power tools and more particularly to indicator devices for power tools. With the advent of smart power tools it has become increasingly important to conveniently convey information to a tool operator with regard to the tool function. For example, in the case of a so-called nutrunner or power driven screwdriver, an indication of function and/or satisfactory result of a tightening process is desirable.

In the past this has been accomplished by displaying the tool performance with three discrete LED's or the like that are located in a single position on the tool. This limits the viewing angle to locations in which the operator can view the LED's. Particularly in assembly and repair operations, this may result in a rather inconvenient display wherein the operator either cannot read the display information or is forced to severely reposition for adequate visibility.

The foregoing illustrates limitations known to exist in present devices and methods. Thus it is apparent that it would be advantageous to provide an alternative directed to overcoming one or more of the limitations set forth above. Accordingly a suitable alternative is provided including features more fully disclosed hereinafter.

SUMMARY OF THE INVENTION

In one aspect of the present invention this is accomplished by providing a light ring assembly comprising a light strip formable to encircle a tool body; means for securing the strip to the body; and means for connecting the strip to a logic device for communicating tool function to an operator.

The foregoing and other aspects will become apparent from the following detailed description of the invention when considered in conjunction with the accompanying drawing figures.

DETAILED DESCRIPTION

Figure 1:
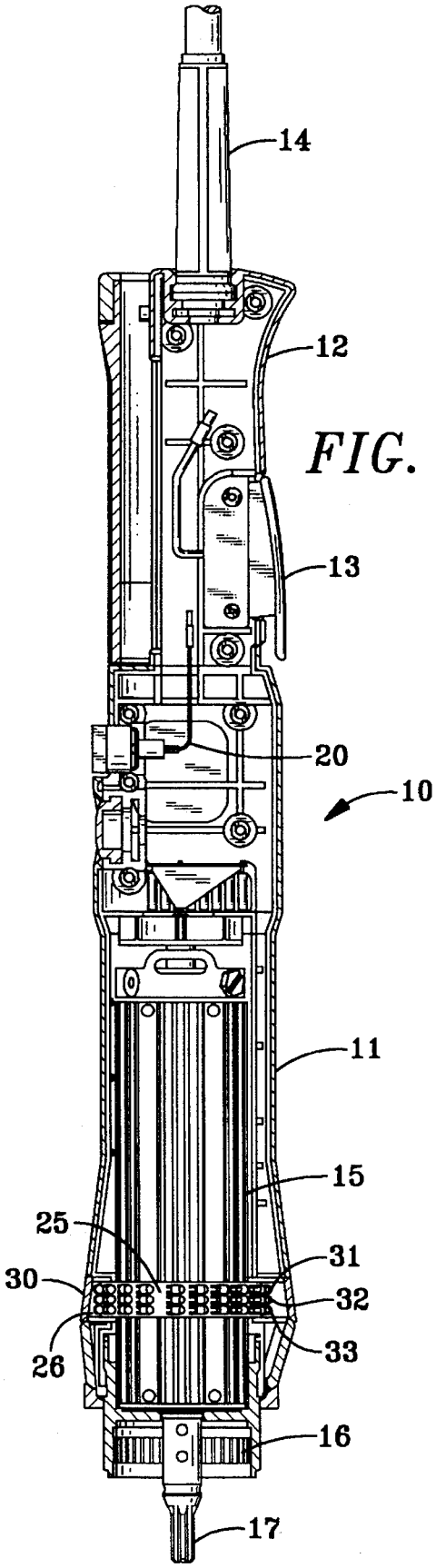
FIG. 1 shows a power tool incorporating a light ring assembly according to the present invention.

Referring to FIG. 1, a typical handheld power tool body is shown and generally designated by the reference numeral 10. Typically, such devices includes a housing 11 including a handle 12, an operating switch 13, which typically supplies power from a power source connection 14 to a motor, which in turn has its output on a gear reducer 16 which in turn drives an output spindle 17. The performance of the tool may be controlled and monitored by a control circuit 20.

Figure 2:
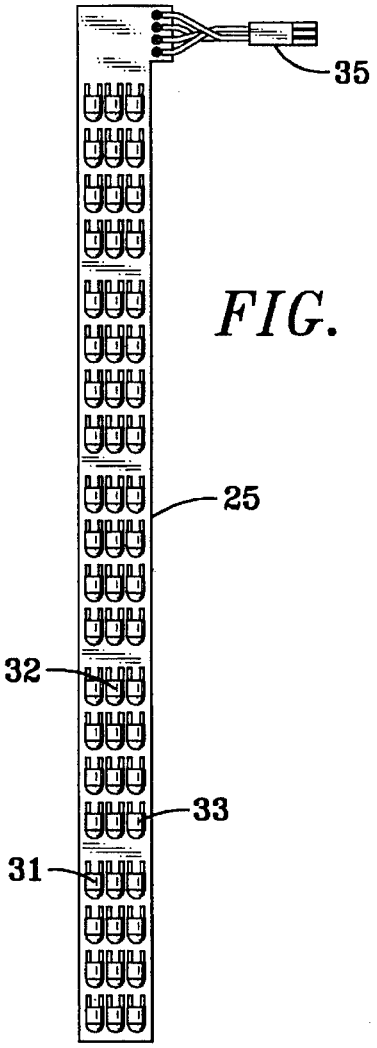
FIG. 2 shows a formable flex circuit according to the present invention.

In the case of the present invention, control functions are displayed on a 360 degree light band 25 located near the power output end of the tool for ready visibility. The light band is shown disposed in a recess formed in the tool housing and is protected by a transparent lens 30. In the case of a preferred embodiment shown, the flex circuit light ring (shown in detail in FIGS. 2 and 3) is provided with three rows of LED's each of a different distinct color. For example, row one indicated by reference numeral 31, may be red. The LED's in row 2 indicated by reference numeral 32 may be amber and the LED's in row 3 indicated by reference numeral 33, may be green signalling for example, tool operation (amber), acceptable operation on completion (green) or rejection (red).

As stated, the purpose of the device is to signal the operator how the tool is performing in application. The decision as to which LED's are to be eluminated is made from a microprocessor which is not part of the present application and may be located either internal or external to the tool. A feature of the present design is the fact that it is modular in construction which makes the tool readily repairable and easy to upgrade to a light ring model. The traditional method would be to hard wire the circuit in place making it extremely difficult to repair or replace.

Figure 3:
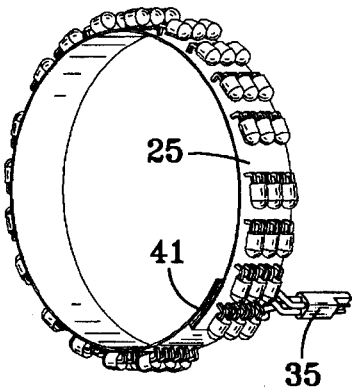
FIG. 3 shows the flex circuit formed in a circular ring for 360 degree viewing according to the present invention.

In the present invention a flexible light circuit 25 may be readily formed into a circular ring as shown in FIG. 3 and placed in recess 26 and thereafter connected by means of a connector 35. The ring may be formed and retained in the circular shape shown in FIG. 3 by means of a VELCRO hook and loop strip the like thereby permitting the light ring to be easily replaced. The transparent lens 30 may also be provided with sufficient flexibility to be readily snapped into place over the installed light band 40.

Having described our invention in terms of a preferred embodiment we do not wish to be limited in the scope of the invention except as claimed.

What is claimed is:

1. A light ring assembly for a power tool comprising:

a light strip formable to encircle a tool body;

means for securing said strip to said body; and means for connecting said strip to a logic device for communicating tool function to an operator.

2. A light ring assembly according to claim 1 wherein:

said light strip comprises a row of information colored lights.

3. A light ring assembly according to claim 1 wherein:

said light strip comprises a plurality of rows of information colored lights.

4. A light ring assembly according to claim 1 wherein:

said means for securing said strip comprises a velcro hook and loop strip.

5. A light ring assembly according to claim 1 wherein:

said means for connecting said strip to a logic device comprises a modular connector.

6. A light ring assembly according to claim 1 wherein:

said light strip is formed on a linear flexible strip of suitable plastic material.

* * * * *